US006911914B2

(12) United States Patent
Mathews, Jr. et al.

(10) Patent No.: US 6,911,914 B2
(45) Date of Patent: Jun. 28, 2005

(54) METHOD AND APPARATUS FOR DETECTING HOT RAIL CAR SURFACES

(75) Inventors: Harry Kirk Mathews, Jr., Clifton Park, NY (US); Walter Vincent Dixon, Delanson, NY (US); David Michael Davenport, Niskayuna, NY (US); Harry Israel Ringermacher, Delanson, NY (US); Paul Kenneth Houpt, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 92 days.

(21) Appl. No.: 10/063,950

(22) Filed: May 29, 2002

(65) Prior Publication Data

US 2003/0187605 A1 Oct. 2, 2003

Related U.S. Application Data

(63) Continuation-in-part of application No. 10/063,218, filed on Mar. 29, 2002, now abandoned.

(51) Int. Cl.[7] ..... G08B 21/00

(52) U.S. Cl. ..... 340/682; 246/169 A; 246/169 D; 340/449; 340/584; 701/19

(58) Field of Search ..... 340/584, 682, 340/933, 449, 425.5; 701/19; 246/169 A, 169 D

(56) References Cited

U.S. PATENT DOCUMENTS

| | | | | |
|---|---|---|---|---|
| 3,731,087 A | * | 5/1973 | King | 246/169 D |
| 4,313,583 A | * | 2/1982 | Bambara et al. | 246/169 A |
| 5,201,483 A | * | 4/1993 | Sutnar et al. | 246/169 A |
| 5,331,311 A | * | 7/1994 | Doctor | 340/463 |
| 5,381,700 A | * | 1/1995 | Grosskopf, Jr. | 340/584 |
| 5,448,072 A | * | 9/1995 | Gallagher | 250/349 |
| 5,677,533 A | * | 10/1997 | Yaktine et al. | 250/342 |

* cited by examiner

*Primary Examiner*—Brent A. Swarthout
(74) *Attorney, Agent, or Firm*—Fletcher Yoder

(57) ABSTRACT

In one embodiment of the present invention, an apparatus for detecting a hot rail car surface comprises: an infrared sensor for acquiring an infrared signal from a rail car surface of a rail car and transducing the infrared signal into an electrical signal; a rank filter for filtering the electrical signal to produce a filtered array; a first peak detector for detecting a maximum filtered value of the filtered array; and a first comparator for comparing the maximum filtered value to a detection threshold to produce a filtered alarm signal.

18 Claims, 2 Drawing Sheets

METHOD AND APPARATUS FOR DETECTING HOT RAIL CAR SURFACES

CROSS REFERENCE TO RELATED APPLICATIONS

This Application is a continuation-in-part of U.S. application Ser. No. 10/063,218, filed Mar. 29, 2002, now abandoned, which application is herein incorporated by reference.

BACKGROUND OF INVENTION

This invention relates generally to the field of detecting excessively hot rail car surfaces and more specifically to the use of rank filters to process infrared signals emitted by rail car surfaces.

While the present disclosure emphasizes application of the present invention to detection of hot rail car wheel bearings, it will be obvious to one of ordinary skill in the art that the present invention is equally applicable to the detection of other hot rail car surfaces such as, by way of example but not limitation, rail car wheels.

Malfunctioning rail car wheel bearings radiate heat due to friction. To detect such overheated bearings, in an attempt to warn the operator and stop the train prior to complete bearing failure and potential train derailment, railroads have developed and deployed wayside hot bearing detectors (HBDs). Typical HBDs utilize pyroelectric infrared sensors for detecting heat profiles of the rail car wheel bearings as the rail cars roll past the sensor. As well as being pyroelectric, however, these sensor devices may often also be piezoelectric; that is, electrical outputs produced by these devices depend not only on the heat sensed, but also on sensed sound and vibration. The electrical noise pulses induced by undesirable piezoelectric effects are known as "microphonic artifacts".

In some instances, microphonic artifacts present magnitudes similar to those of hot bearings. As conventional HBDs rely mainly on signal magnitudes for detection, microphonics and other phenomena can induce false alarms that result in stopping a train unnecessarily. Such false stops cost the railroad significant time and money.

While the signal magnitudes of microphonic artifacts are comparable to the signal magnitudes produced by truly hot bearings, the microphonic artifacts tend to present themselves as substantially sharper "spikes." An opportunity exists, therefore, to reduce HBD sensitivity to microphonic artifacts through improved signal processing.

SUMMARY OF INVENTION

The opportunities described above are addressed, in one embodiment of the present invention, by an apparatus for detecting a hot rail car surface comprising: an infrared sensor for acquiring an infrared signal from a rail car surface of a rail car and transducing the infrared signal into an electrical signal; a rank filter for filtering the electrical signal to produce a filtered array; a first peak detector for detecting a maximum filtered value of the filtered array; and a first comparator for comparing the maximum filtered value to a detection threshold to produce a filtered alarm signal.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
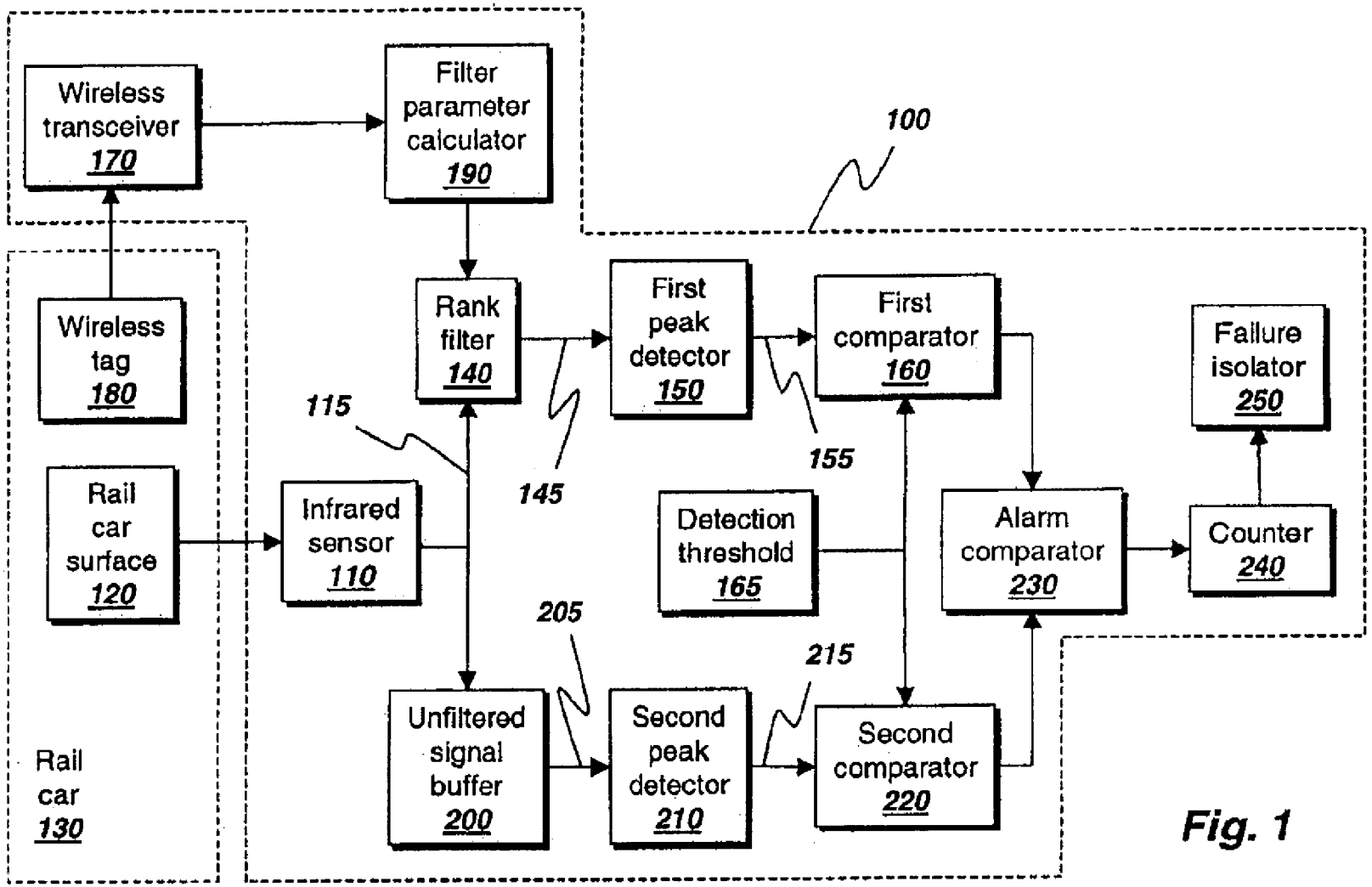
FIG. 1 illustrates a block diagram of an apparatus for detecting a hot rail car surface in accordance with one embodiment of the present invention.

In accordance with one embodiment of the present invention, FIG. 1 illustrates a block diagram of an apparatus 100 for detecting a hot rail car surface comprising an infrared sensor 110, a rank filter 140, a first peak detector 150, and a first comparator 160. In operation, infrared sensor 110 acquires an infrared signal from a rail car surface 120 of a rail car 130 and transduces the infrared signal into an electrical signal 115. Rank filter 140 filters electrical signal 115 to produce a filtered array 145.

The process of filtering using rank filter 140 comprises: incorporating a new sample of electrical signal 115 into a data buffer; discarding the oldest sample in the data buffer; finding a rank value of the data buffer; and storing the rank value in filtered array 145. The length of the data buffer is referred to as the "filter length." The "rank" of the filter is a quantity between 0 and 1 and defines the fraction of the data buffer containing values smaller than the rank value. For example, if the rank equals 0.5, then the rank filter finds the median value of the data buffer; if the rank equals 0.8, then the rank filter finds the 80th percentile value (i.e., the smallest value greater than 80 percent of all the values); if the rank equals 0, then the rank filter finds the minimum value; and if the rank equals 1, then the rank filter finds the maximum value.

Filtered array 145 is passed to peak detector 150 wherein a maximum filtered value 155 is detected, and first comparator 160 compares maximum filtered value 155 to a detection threshold 165 to produce a filtered alarm signal useful for alerting a train operator of an incipient failure of rail car surface 120.

Infrared sensor 110 comprises any electrical or electronic device capable of converting infrared electromagnetic radiation to electrical signals; examples of infrared sensor 110 include, without limitation, photodiodes, phototransistors, photomultiplier tubes, and vidicon tubes. Rail car 130 comprises any vehicle capable of traveling on railroad tracks; examples of rail car 130 include, without limitation, box cars, ore cars, flat cars, tank cars, and locomotives. Rail car surface 120 comprises any surface of rail car 130 visible from a wayside; examples of rail car surface 120 include, without limitation, wheel bearing surfaces and wheel surfaces. Rank filter 140, first peak detector 150, and first comparator 160 comprise any electrical or electronic devices capable of performing the indicated operations; examples of rank filter 140, first peak detector 150, and first comparator 160 include, without limitation: analog electronic processors comprising, for example, operational amplifiers, sample and hold circuits, peak hold circuits, analog comparators, analog computation modules, and any combination thereof; and digital electronic processors comprising, for example, single chip digital signal processors (DSPs), microprocessors, microcomputers, microcontrollers, small-, medium-, and large-scale integrated circuits, programmable logical arrays, programmable gate arrays, and any combination thereof.

In another embodiment in accordance with the embodiment illustrated in FIG. 1, apparatus 100 further comprises a wireless transceiver 170 and a filter parameter calculator 190. In operation, wireless transceiver 170 acquires rail car surface characteristics transmitted by a wireless tag 180 mounted on rail car 130. As a function of the rail car surface characteristics, filter parameter calculator 190 calculates a filter length and a rank of rank filter 140.

By incorporating knowledge of the particular rail car surface under observation, better performance of rank filter 140 may be realized. For example, rank filter 140 passes signal pulses having widths longer than the product of the rank and the filter length; pulses narrower than the product of the rank and the filter length are rejected. A truly hot bearing produces a hot bearing signal pulse whose width is a function of bearing geometry and of the known geometry of infrared sensor 110. With knowledge of the bearing geometry, for example, communicated by wireless tag 180, the expected width of the hot bearing signal pulse can be calculated, and the filter length and rank of rank filter 140 can be tailored to pass the hot bearing signal pulse while rejecting narrower pulses due to microphonic artifact.

Wireless transceiver 170 and wireless tag 180 comprise any devices capable of wireless communication; examples of wireless transceiver 170 and wireless tag 180 include, without limitation: electromagnetic receivers and transmitters operating at, for example, radio, infrared, or optical frequencies; commercially available receivers and transmitters known as "Automatic Equipment Identification" (AEI); as well as mechanical receivers and transmitters such as, for example, microphones and loudspeakers.

In still another embodiment in accordance with the embodiment illustrated in FIG. 1, apparatus 100 further comprises an unfiltered signal buffer 200, a second peak detector 210, a second comparator 220, and an alarm comparator 230. In operation, unfiltered signal buffer 200 buffers samples of electrical signal 115 to produce an unfiltered array 205. Second peak detector 210 detects a maximum unfiltered value 215, which second comparator 220 compares to detection threshold 165 to produce an unfiltered alarm signal. A censored false alarm signal results when alarm comparator 230 compares the unfiltered alarm signal to the filtered alarm signal. A difference between the unfiltered alarm signal and the filtered alarm signal indicates that rank filter 140 has successfully prevented a false alarm. Knowledge that a false alarm would have otherwise occurred can be used as an indicator that apparatus 100 may be operating in a degraded mode.

In yet another embodiment in accordance with the embodiment illustrated in FIG. 1, the censored false alarm signal comprises a binary signal having a true value when the unfiltered alarm signal differs from the filtered alarm signal and a false value otherwise, and apparatus 100 further comprises a counter 240. Counter 240 counts the false values (i.e., the number of censored false alarms) to produce a censored alarm count. While the existence of censored false alarms is indicative of degraded behavior, the censored false alarm count is further indicative of the duration and severity of the degradation.

In again another embodiment in accordance with the embodiment illustrated in FIG. 1, apparatus 100 further comprises a failure isolator 250. Failure isolator 250 diagnoses a failure mode from the censored false alarm count. By accumulating a censored false alarm count time history, failure isolator 250 may employ statistical hypothesis testing techniques to identify (i.e., isolate) which among a group of previously identified failure modes is most likely to have occurred.

Unfiltered signal buffer 200, second peak detector 210, second comparator 220, alarm comparator 230, counter 240, and failure isolator 250 comprise any electrical or electronic devices capable of performing the indicated operations; examples of unfiltered signal buffer 200, second peak detector 210, second comparator 220, alarm comparator 230, counter 240, and failure isolator 250 include, without limitation: analog electronic processors comprising, for example, operational amplifiers, sample and hold circuits, peak hold circuits, analog comparators, analog computation modules, and any combination thereof; and digital electronic processors comprising, for example, single chip digital signal processors (DSPs), microprocessors, microcomputers, microcontrollers, small-, medium-, and large-scale integrated circuits, programmable logical arrays, programmable gate arrays, and any combination thereof.

Figure 2:
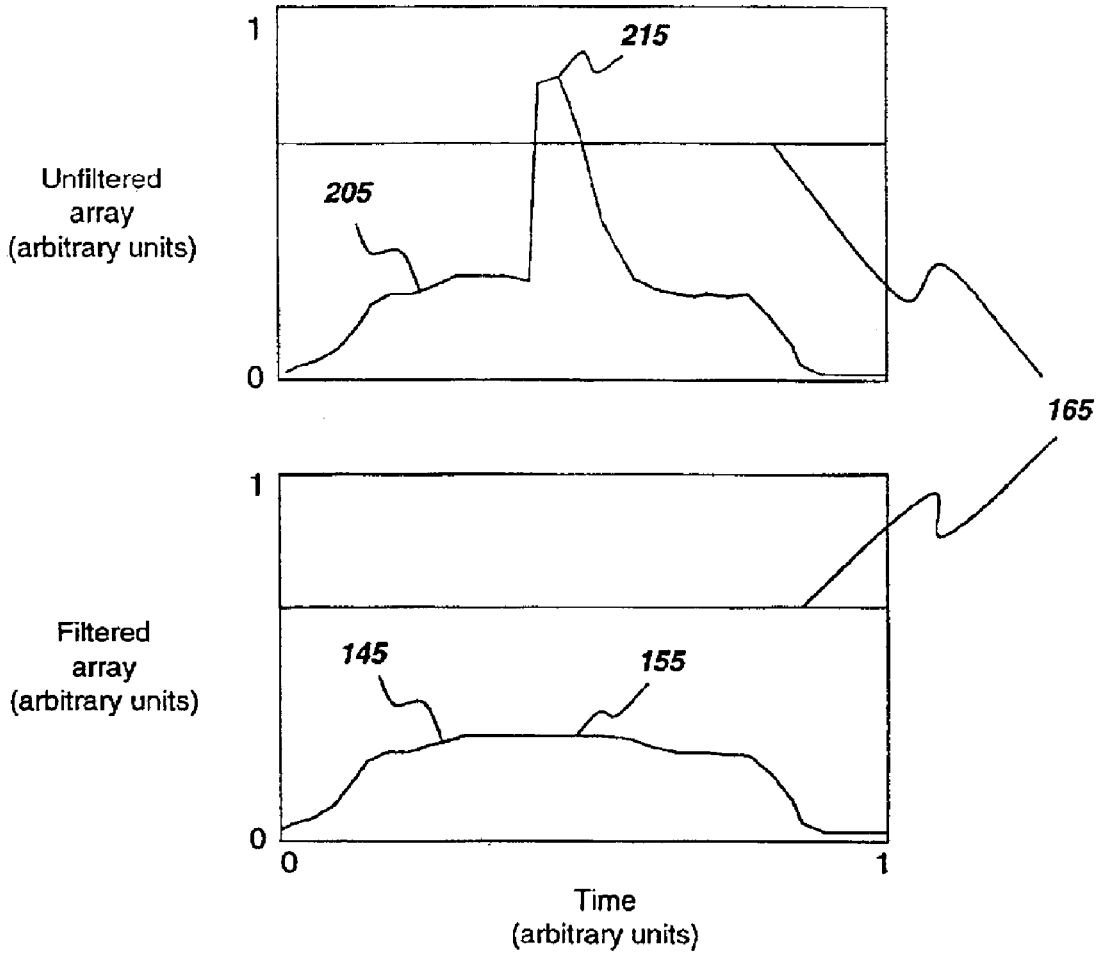
FIG. 2 illustrates filtered array and unfiltered array signals in accordance with the embodiment illustrated in FIG. 1.

In accordance with the embodiment illustrated in FIG. 1, FIG. 2 illustrates filtered array 145 and unfiltered array 205 as may be generated during operation. Unfiltered array 205 suffers a microphonic artifact placing maximum unfiltered value 215 clearly above detection threshold 165. In contrast, the microphonic artifact has been removed in filtered array 145. Maximum filtered value 155 thus stays well below detection threshold 165, and a false alarm is avoided.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An apparatus for detecting a hot rail car surface comprising:

an infrared sensor for acquiring an infrared signal from a rail car surface of a rail car and transducing said infrared signal into an electrical signal;

a rank filter for filtering said electrical signal to produce a filtered array;

a first peak detector for detecting a maximum filtered value of said filtered array; and a first comparator for comparing said maximum filtered value to a detection threshold to produce a filtered alarm signal.

2. The apparatus of claim 1 wherein said rank filter has a rank of about one-half.

3. The apparatus of claim 1 further comprising:

a wireless transceiver for acquiring rail car surface characteristics from a wireless tag mounted on said rail car; and a filter parameter calculator for calculating a filter length and rank of said rank filter as a function of said rail car surface characteristics.

4. The apparatus of claim 1 further comprising:

an unfiltered signal buffer for buffering said electrical signal to produce an unfiltered array;

a second peak detector for detecting a maximum unfiltered value of said unfiltered array;

a second comparator for comparing said maximum unfiltered value to said detection threshold to produce an unfiltered alarm signal; and an alarm comparator for comparing said unfiltered alarm signal to said filtered alarm signal to produce a censored false alarm signal.

5. The apparatus of claim 4 wherein:

said censored false alarm signal comprises a binary signal having a true value when said unfiltered alarm signal differs from said filtered alarm signal and a false value otherwise; and said apparatus further comprises a counter for counting said false values to produce a censored false alarm count.

6. The apparatus of claim 5 further comprising a failure isolator for diagnosing a failure mode from said censored false alarm count.

7. An apparatus for detecting a hot rail car surface comprising:

an infrared sensor for acquiring an infrared signal from a rail car surface of a rail car and transducing said infrared signal into an electrical signal;

a rank filter for filtering said electrical signal to produce a filtered array;

a first peak detector for detecting a maximum filtered value of said filtered array;

a first comparator for comparing said maximum filtered value to a detection threshold to produce a filtered alarm signal;

a wireless transceiver for acquiring rail car surface characteristics from a wireless tag mounted on said rail car;

a filter parameter calculator for calculating a filter length and rank of said rank filter as a function of said rail car surface characteristics;

an unfiltered signal buffer for buffering said electrical signal to produce an unfiltered array;

a second peak detector for detecting a maximum unfiltered value of said unfiltered array;

a second comparator for comparing said maximum unfiltered value to said detection threshold to produce an unfiltered alarm signal; and an alarm comparator for conspiring said unfiltered alarm signal to said filtered alarm signal to produce a censored false alarm signal.

8. The apparatus of claim 7 wherein:

said censored false alarm signal comprises a binary signal having a true value when said unfiltered alarm signal differs from said filtered alarm signal and a false value otherwise; and said apparatus further comprises a counter for counting said false values to produce a censored false alarm count.

9. The apparatus of claim 8 further comprising a failure isolator for diagnosing a failure mode from said censored false alarm count.

10. A method for detecting hot rail car surfaces, the method comprising:

acquiring an infrared signal from a rail car surface of a rail car;

transducing said infrared signal into an electrical signal;

filtering said electrical signal using a rank filter to produce a filtered array;

detecting a maximum filtered value of said filtered array; and comparing said maximum filtered value to a detection threshold to produce a filtered alarm signal.

11. The method of claim 10 wherein said rank filter has a rank of about one-half.

12. The method of claim 10 further comprising:

acquiring rail car surface characteristics from a wireless tag mounted on said rail car; and calculating a filter length and rank of said rank filter as a function of said rail car surface characteristics.

13. The method of claim 10 further comprising:

buffering said electrical signal to produce an unfiltered array;

detecting a maximum unfiltered value of said unfiltered array;

comparing said maximum unfiltered value to said detection threshold to produce an unfiltered alarm signal; and comparing said unfiltered alarm signal to said filtered alarm signal to produce a censored false alarm signal.

14. The method of claim 13 wherein:

said censored false alarm signal comprises a binary signal having a true value when said unfiltered alarm signal differs from said filtered alarm signal and a false value otherwise; and said method further comprises counting said false values to produce a censored false alarm count.

15. The method of claim 14 further comprising diagnosing a failure mode from said censored false alarm count.

16. A method for detecting hot rail car surfaces, the method comprising:

acquiring an infrared signal from a rail car surface of a rail car;

transducing said infrared signal into an electrical signal;

filtering said electrical signal using a rank filter to produce a filtered array;

detecting a maximum filtered value of said filtered array;

comparing said maximum filtered value to a detection threshold to produce a filtered alarm signal;

acquiring rail car surface characteristics from a wireless tag mounted on said rail car;

calculating a filter length and rank of said rank filter as a function of said rail car surface characteristics;

buffering said electrical signal to produce an unfiltered array;

detecting a maximum unfiltered value of said unfiltered array;

comparing said maximum unfiltered value to said detection threshold to produce an unfiltered alarm signal; and comparing said unfiltered alarm signal to said filtered alarm signal to produce a censored false alarm signal.

17. The method of claim 16 wherein:

said censored false alarm signal comprises a binary signal having a true value when said unfiltered alarm signal differs from said filtered alarm signal and a false value otherwise; and said method further comprises counting said false values to produce a censored false alarm count.

18. The method of claim 17 further comprising diagnosing a failure mode from said censored false alarm count.

* * * * *